US007303380B1

(12) United States Patent
Atkins

(10) Patent No.: US 7,303,380 B1
(45) Date of Patent: Dec. 4, 2007

(54) ROTARY ENGINE WITH IMPROVED SEAL ASSEMBLY

(76) Inventor: Dave Atkins, 16715 Meridian Ave. E., Puyallup, WA (US) 98375

( * ) Notice: Subject to any disclaimer, the term of this patent is extended or adjusted under 35 U.S.C. 154(b) by 0 days.

(21) Appl. No.: 11/595,503

(22) Filed: Nov. 10, 2006

Related U.S. Application Data

(63) Continuation-in-part of application No. 11/353,717, filed on Feb. 14, 2006.

(51) Int. Cl.
*F03C 2/00* (2006.01)
*F04C 2/00* (2006.01)

(52) U.S. Cl. ..... 418/61.2; 418/113; 418/120; 418/123; 418/142; 277/357; 277/398; 277/403

(58) Field of Classification Search ..... 418/61.2, 418/113, 120–123, 142; 277/357, 398, 403
See application file for complete search history.

(56) References Cited

U.S. PATENT DOCUMENTS 2,988,065 A * 6/1961 Wankel et al. ..... 418/61.2
3,300,124 A * 1/1967 Jones ..... 418/121
3,685,922 A * 8/1972 Lamm ..... 418/113
3,711,229 A * 1/1973 Kurio ..... 418/122
3,851,999 A * 12/1974 Bibbens ..... 418/61.2
3,876,346 A * 4/1975 Kokochak ..... 418/122
3,961,871 A * 6/1976 Kurio ..... 418/123
4,025,247 A * 5/1977 Kurio et al. ..... 418/120

FOREIGN PATENT DOCUMENTS

JP 53071708 A * 6/1978 ..... 418/142
JP 63038601 A * 2/1988 ..... 418/122

* cited by examiner

*Primary Examiner*—Theresa Trieu
(74) *Attorney, Agent, or Firm*—Delbert J. Barnard

(57) ABSTRACT

Corner seal sockets (26) are formed at the end of apex seal slots (58) formed in a rotor (10). A twisted split washer spring (70) is positioned in each socket (26) between the base wall (28) of the socket (26) and the inner end of the corner seal (16). The springs (70) bias the outer end surfaces of the corner seals (16) against the inner side surfaces of the housing sidewalls (20, 22). A radial apex seal slot (32) is formed in each corner seal (16). The base (38) of each slot (32) is substantially semi cylindrical in shape. It and the cylindrical peripheral surface (44) of the corner seal (16) form an arch shaped bight that connects side portions of the corner seals (16) together. End portions of the apex seals (18) extend into the apex seal slots (32) in the corner seals (16). The end portions of the apex seal biasing spring (60) contacts spring abutments (52, 54) which project radially inwardly from the outer ends of the apex seal (18). The corner seal may have a recessed outer face surrounded by a radially narrow seal surface.

10 Claims, 10 Drawing Sheets

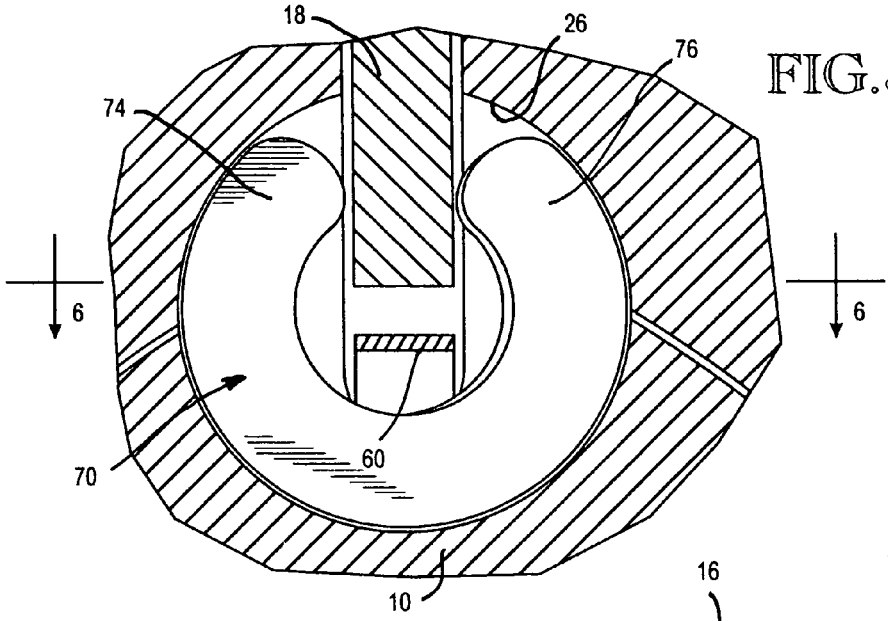
FIG.5
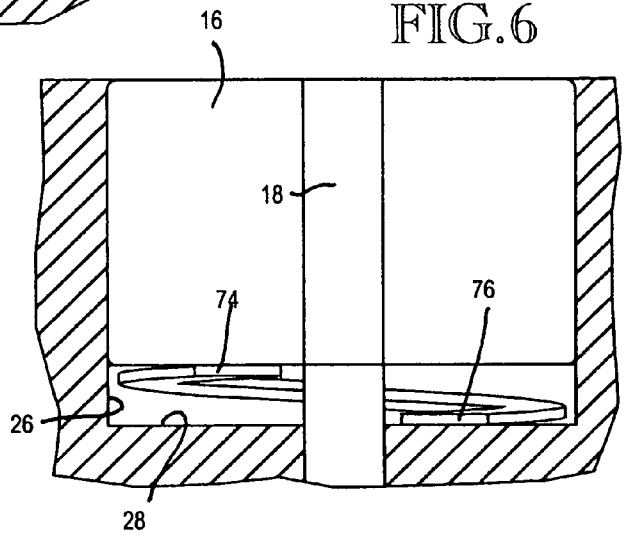
FIG.6
FIG.7
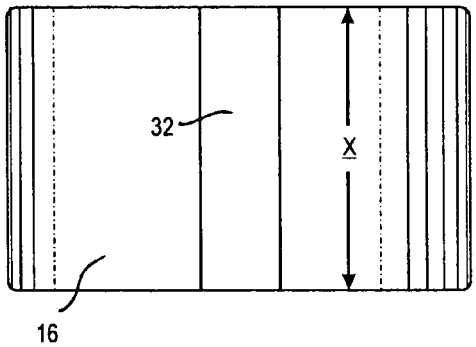
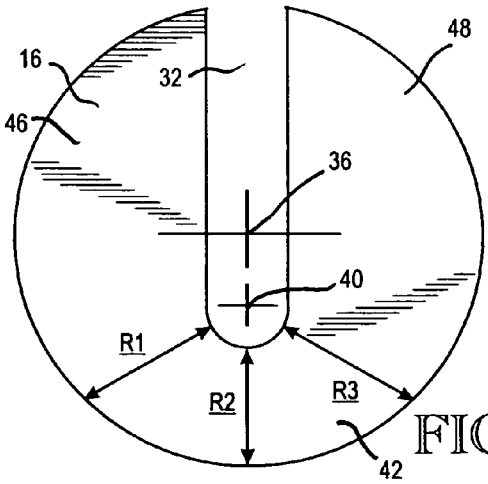
FIG.8
FIG.9
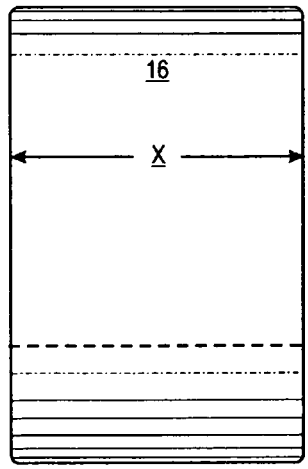

ROTARY ENGINE WITH IMPROVED SEAL ASSEMBLY

RELATED APPLICATION

This application is a continuation-in-part of my U.S. Ser. No. 11/353,717, filed Feb. 14, 2006 and entitled Rotary Engine Seal Assembly.

TECHNICAL FIELD

The present invention relates to eccentric rotary engines. More particularly, it relates to improvements in the seals used for resisting the flow of gases from zones of high pressure to zones of low pressure in the motor housing.

BACKGROUND OF THE INVENTION

Eccentric rotary engines are rotary engines in which motion is imported to a shaft by a rotor that is eccentric to the shaft. A leading eccentric rotor engine is the "Wankel" engine, early examples of which are disclosed in U.S. Pat. No. 2,988,065, granted Jun. 13, 1961, to Felix Wankel and Ernst Hoeppner. A popular type of this motor includes a three-lobe rotor which is rotatable inside a rotor chamber formed in a housing or stator. The rotor is generally in the shape of a triangle having three lobes. Seals carried by apex portions of the lobes slide along an inner peripheral surface of the rotor cavity which is generally referred to as being epitrochoidal or trochoidal in shape. Side seals that are embedded in the sides of the rotor make sliding engagement with the inner surfaces of the sidewalls of the rotor chamber. Corner seals are embedded in the corner regions of the rotor where the side seals substantially meet the apex seals. The rotor cavity has intake and exhaust ports. As the rotor rotates within the rotor cavity, the side faces of the rotor cooperate with the walls of the cavity to define intake, compression, and exhaust chambers, so that during rotation of the rotor, the four phases of intake, compression, expansion, and exhaust are provided during each revolution of the rotor.

U.S. Pat. No. 3,876,346, granted Apr. 8, 1975, to David G. Kokochak shows a corner seal having a square bottom apex seal slot. The shortest radial dimension is at the lower corners of the apex seal slot or the bottom meets the sidewalls of the slot. This radius dimension increases from the corner regions to the center of the bottom of the apex seal recess. This construction of the corner seal makes the corner seal susceptible to breaking at the corner regions of the apex seal slot.

Known corner seals are susceptible to breakage at a frequent enough rate that there is a need to address the problem and provide an improved corner seal having a longer use life. It is the primary object of the present invention to address this problem and provide an improved corner seal. It is an object of the present invention to provide a corner seal that performs its sealing function effectively and which is durable and has a longer use life than conventional corner seals. Another object of the invention is to provide an improved combination of an apex seal and corner seals at its two ends.

BRIEF SUMMARY OF THE INVENTION

The corner seals of the present invention have a generally cylindrical body that includes parallel sides and a generally cylindrical periphery. An apex seal slot is formed in each corner seal. Each apex seal slot has a substantially semi-cylindrical inner end portion and substantially parallel sides that extend radially outwardly from the inner end portion to an outer end slot opening. The apex seal slot in the corner seal divides the corner seal into two side parts that are connected together by an arcuate bight that is generally semi cylindrical on the inside, at the base of the slot, and is semi cylindrical on its outside. This shape where the two halves of the corner seal are joined, together with the radial depth dimension of the connecting bight portion, allows the corner seal to absorb and carry the forces that it encounters during use without breaking in response to those forces.

The substantially semi-cylindrical inner end portion of the apex seal slot in the corner seal has a geometrical axis that is spaced from and is parallel to the geometrical axis of the generally cylindrical body of the corner seal. The distance between the geometrical axis of the generally cylindrical body of the corner seal and the geometrical axis of the substantially semi-cylindrical inner end portion of the apex seal slot is larger than the radius of the substantially semi-cylindrical inner end portion of the apex seal slot in the corner seal.

Preferably, the generally cylindrical body of the corner seal has a diameter that is larger than its side-to-side width.

In a preferred embodiment, the outer side of each corner seal includes a center recess surrounded by a radially narrow sealing surface that contacts the adjacent sidewall of the housing. This construction reduces the area of the corner seal that is in contact with the sidewall of the housing, reducing drag and friction caused heat, an improvement that increases the useful life of the seal assembly and increases the power developed by the engine.

The present invention includes providing a twisted split washer spring in each corner seal socket, positioned axially between the inner endwall of the socket and the corner seal that is in the socket. The twisted split washer springs each have a slot that is in alignment with the apex seal slot in the lobe and the apex seal slot in the corner seals. Opposite end portions of the apex seal extend from the slot in the lobe of the rotor, through the slots in the twisted washer springs, into the apex seal slots in the corner seals.

Preferably, the opposite end portions of the apex seal include radially inwardly extending spring end abutments. An arcuate leaf spring is positioned in the apex seal slot below the apex seal. The leaf spring is radially outwardly concave and radially inwardly convex. The leaf spring has ends contiguous the spring end abutments on the apex seal. The spring end abutments are positioned in the apex seal slots in the corner seals and the leaf springs extend at their ends into the apex seal slots in the corner seals.

An aspect of the invention is to provide an apex seal that is divided by a break into major and minor portions, each of which has a length dimension confronting the peripheral wall of the housing.

Other objects, advantages and features of the invention will become apparent from the description set forth below, from the drawings, and from the principles that are embodied in the specific structures that are illustrated and described.

BRIEF DESCRIPTION OF THE SEVERAL VIEWS OF THE DRAWINGS

Like reference numerals and letter refer to like parts throughout the several views of the drawing, and:

FIG. 5 is a fragmentary sectional view taken substantially along line 5-5 of FIG. 4, showing the twisted split washer corner seal spring in elevation;

FIG. 6 is a sectional view taken substantially along line 6-6 of FIG. 5.

FIG. 7 is a view looking towards the periphery of the corner seal, and into the apex seal slot;

FIG. 8 is a side elevational view of the corner seal shown by FIG. 7;

FIG. 9 is a view looking towards the periphery of the corner seal, ninety degrees (90°) from FIG. 7;

DETAILED DESCRIPTION OF THE ILLUSTRATED EMBODIMENT

Figure 1:
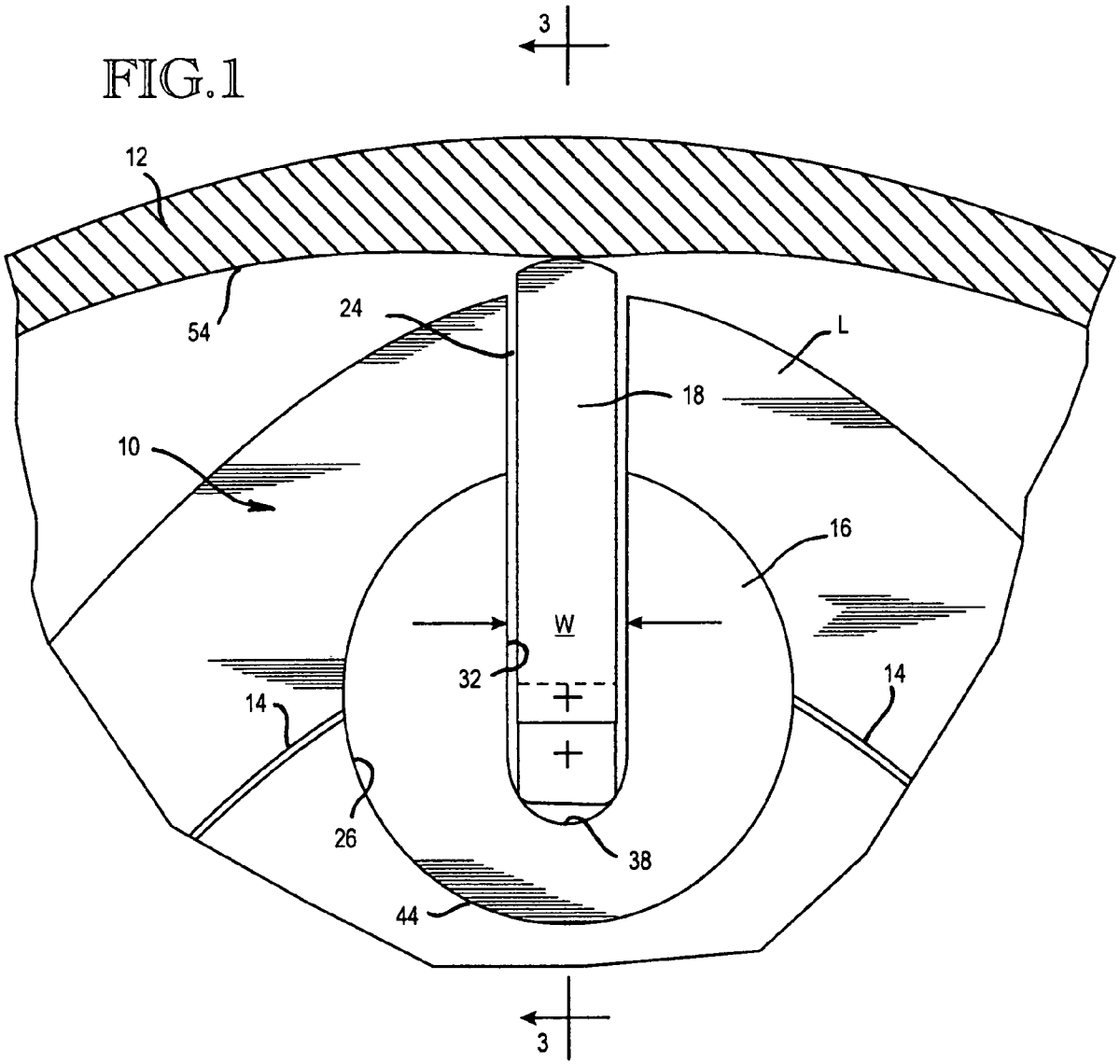
FIG. 1 is a fragmentary side elevational view, showing a portion of the housing in section and a lobe portion of the rotor, the apex seal, a corner seal and end portions of two side seals in elevation.
Figure 3:
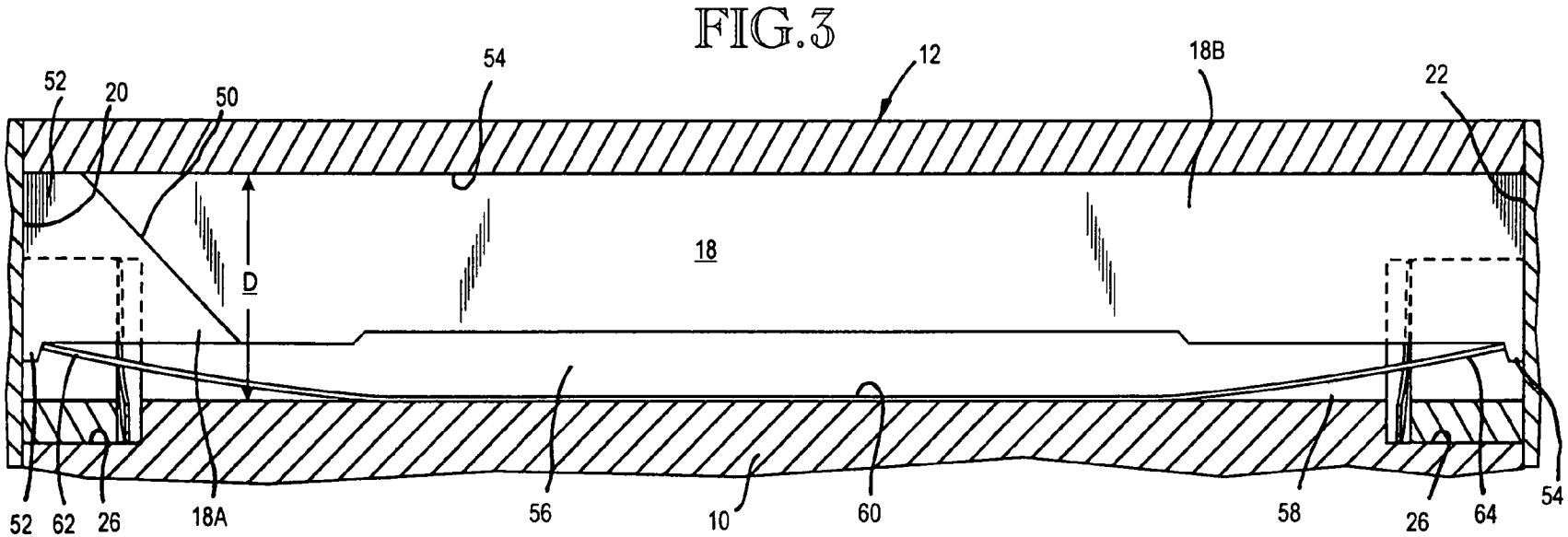
FIG. 3 is a fragmentary axial sectional view showing the rotor, the stator and the corner seals in section, and showing the apex seal and the apex seal spring in elevation.
Figure 4:
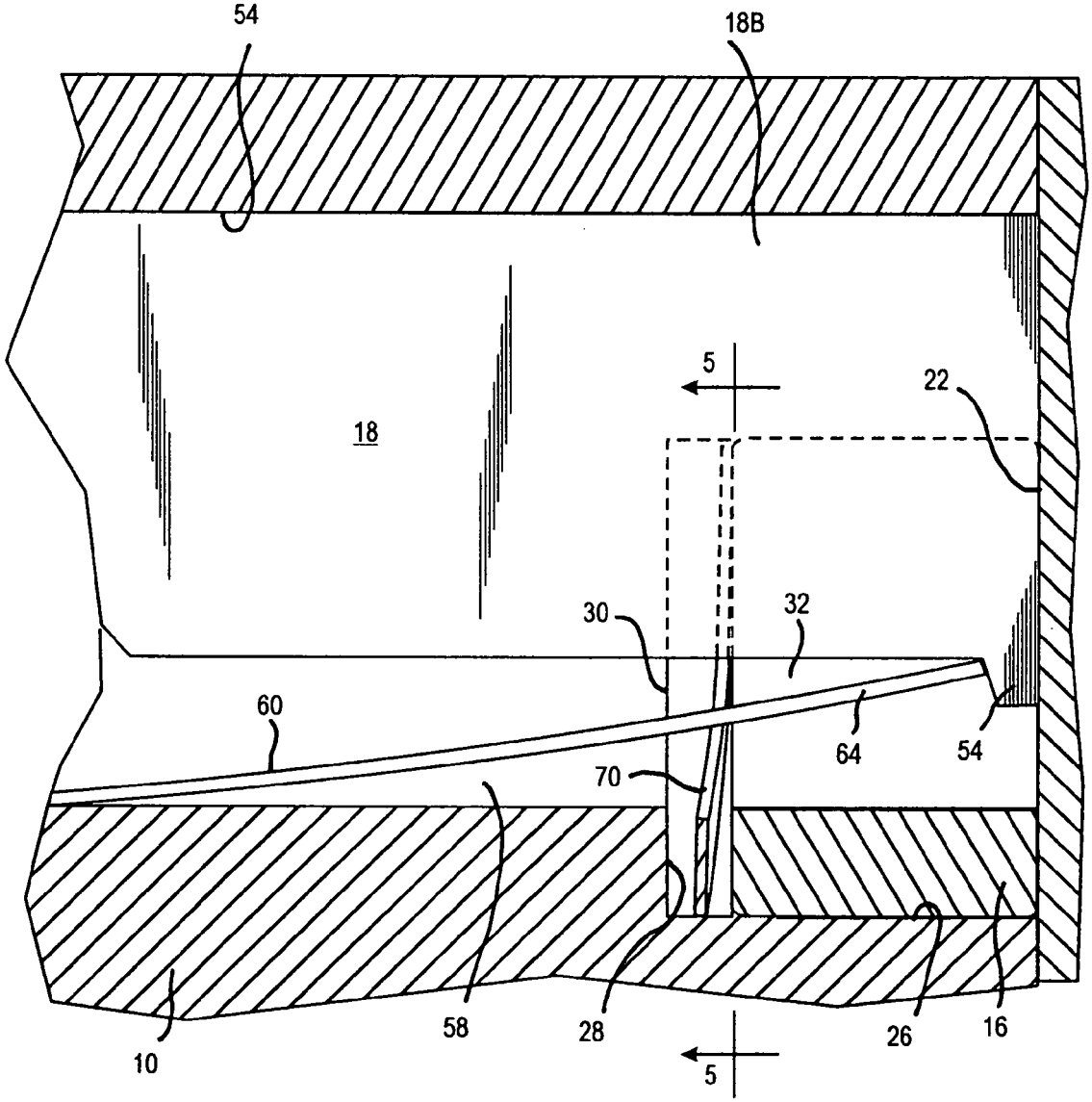
FIG. 4 is an enlarged scale view of the right end portion of FIG. 3.
Figure 10:
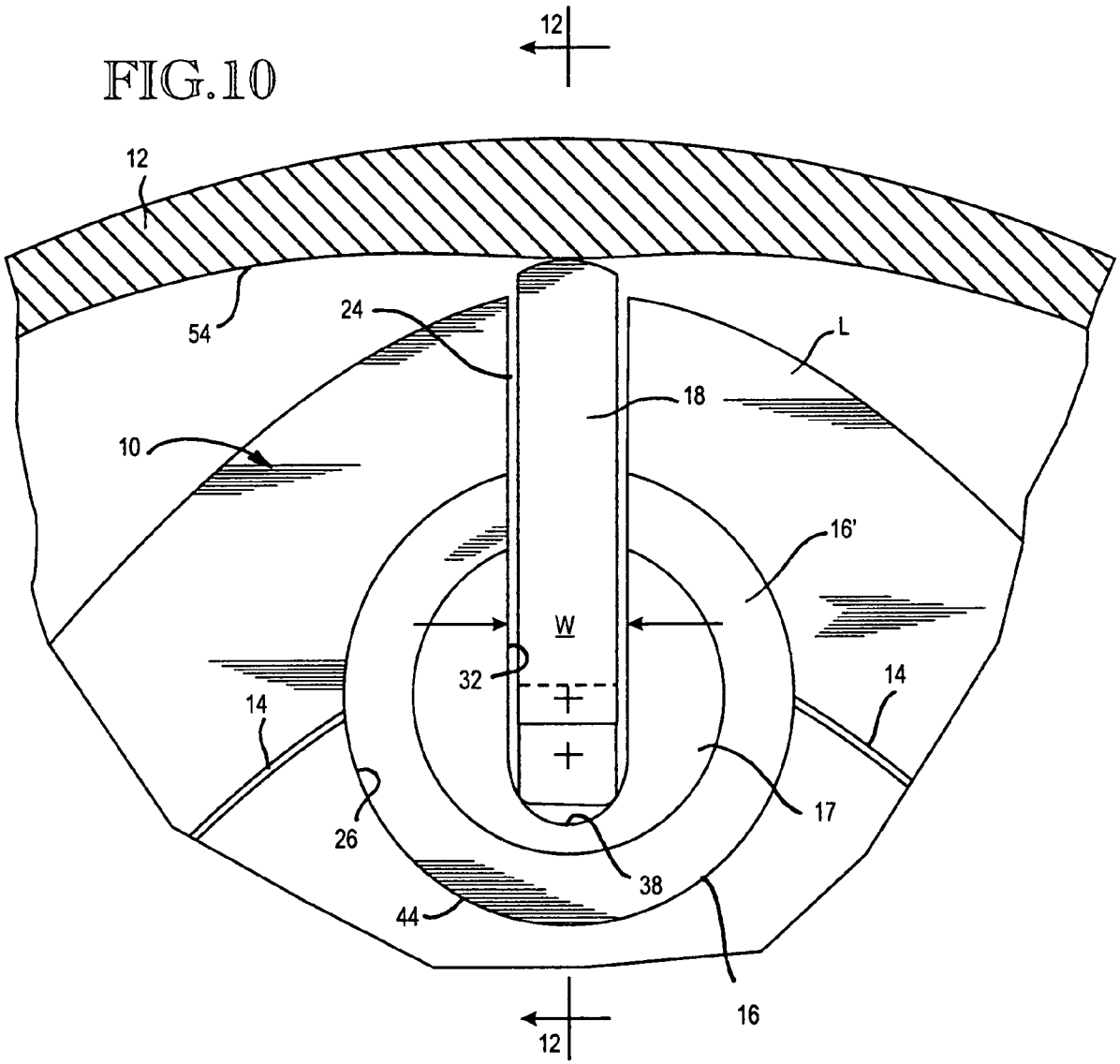
FIG. 10 is a view like FIG. 1, but showing a center recess in the outer face of the corner seal surrounded by a radially narrow sealing area that contacts the adjacent sidewall of the housing.
Figure 11:
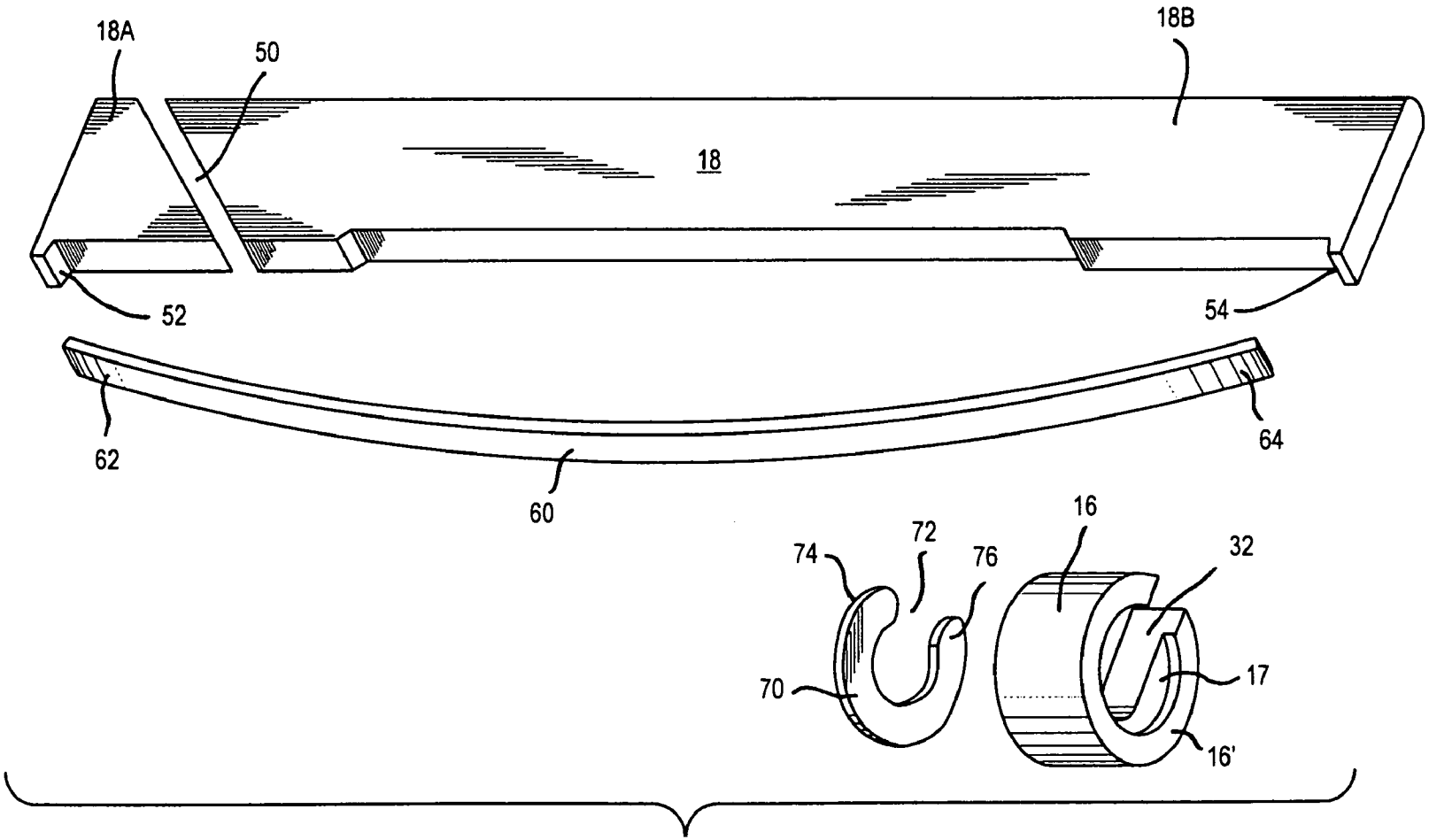
FIG. 11 is a view like FIG. 2, but showing the recessed corner seal.
Figure 12:
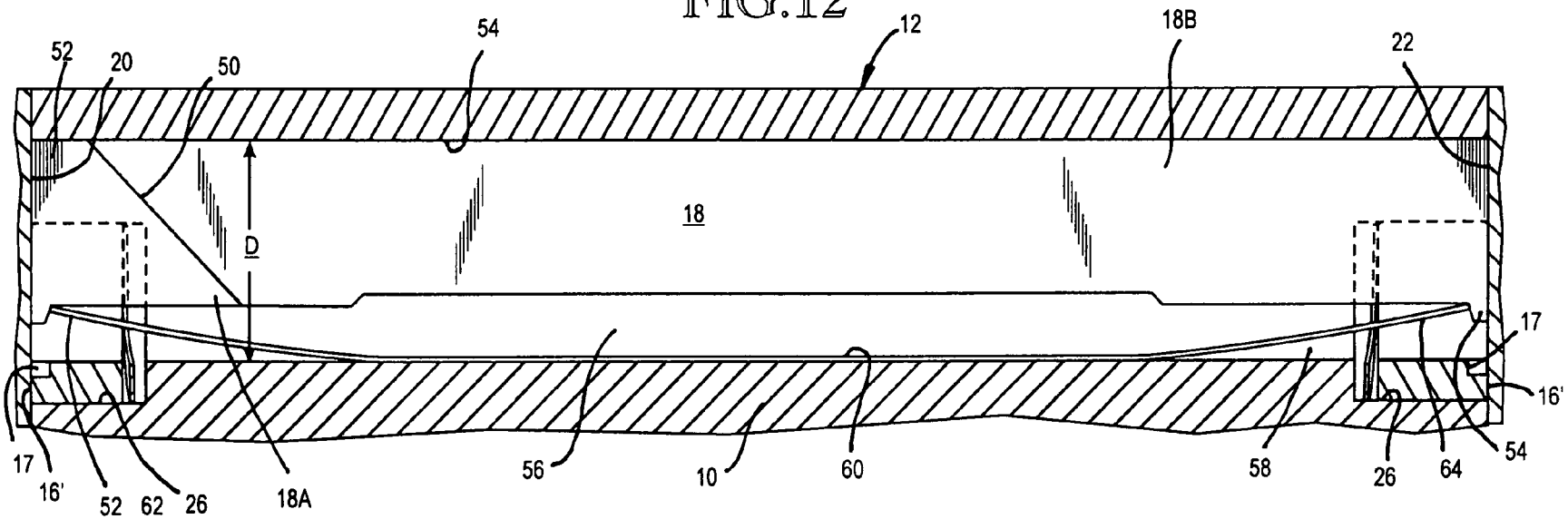
FIG. 12 is a view like FIG. 3, but showing the outer faces of the corner seals with recessed centers.
Figure 13:
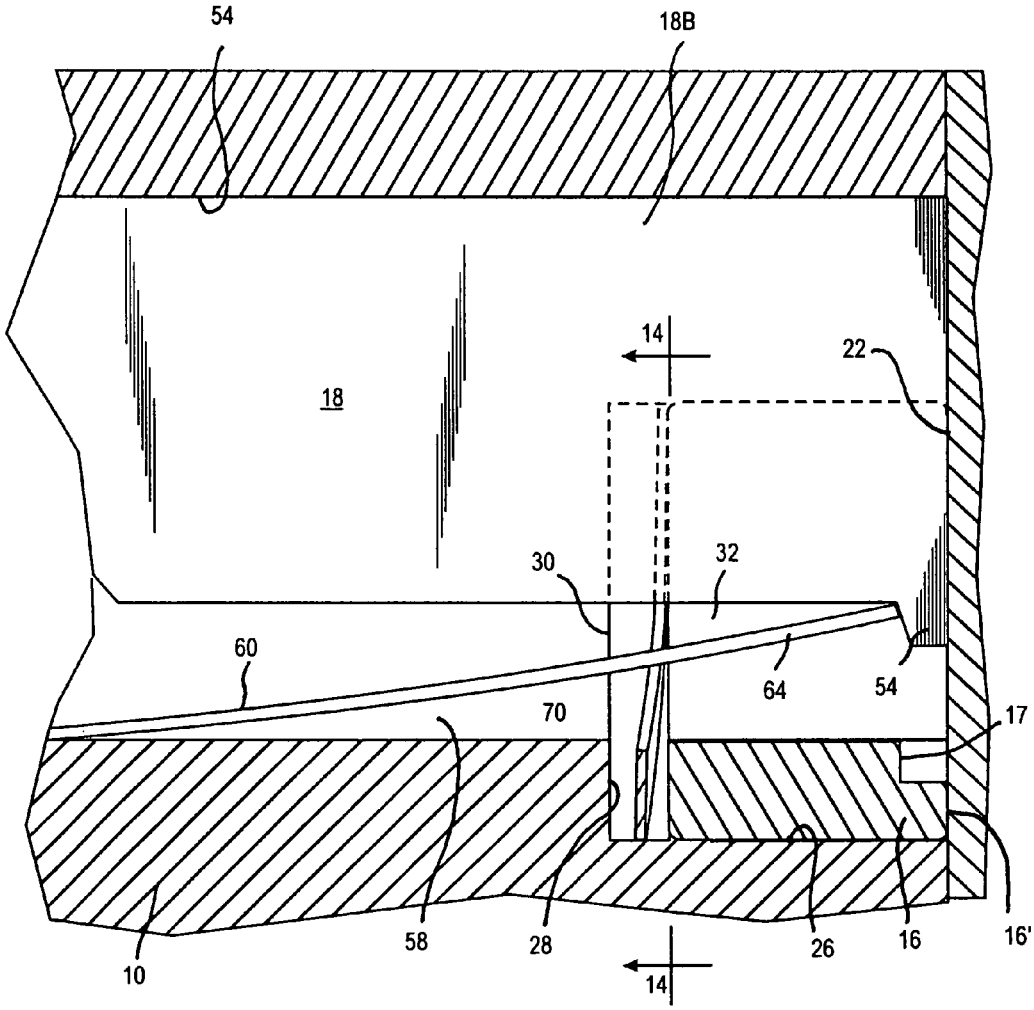
FIG. 13 is a view like FIG. 4, but showing the center recess in the outer face of the corner seal.
Figure 14:
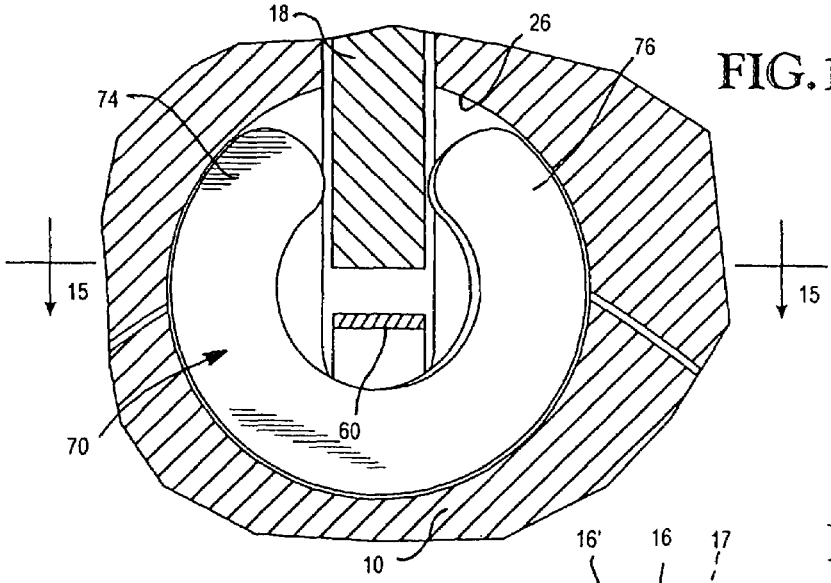
FIG. 14 is a view like FIG. 5, showing that the center recess and the outer face of the corner seal does not change the inner end of the corner seal.
Figure 15:
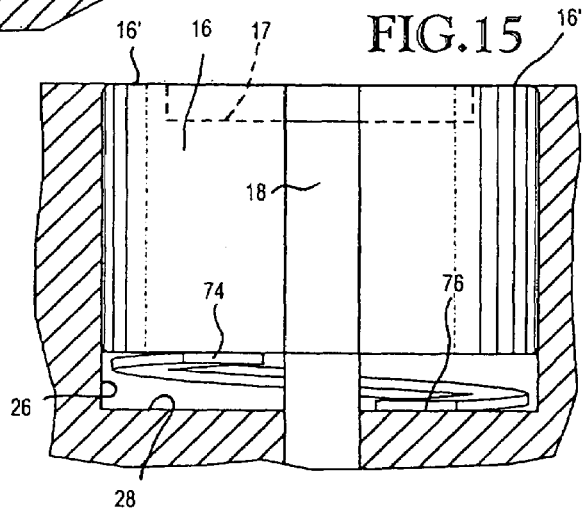
FIG. 15 is a view like FIG. 5, but showing the center recess in the outer face of the corner seal.
Figure 16:
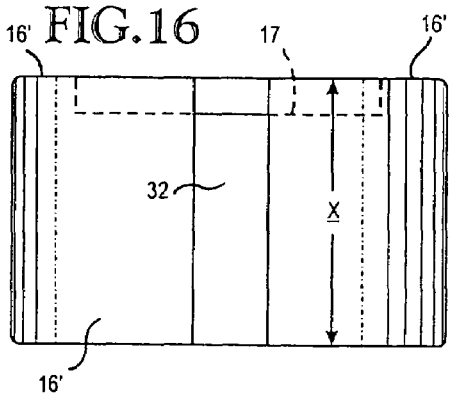
FIG. 16 is a view like FIG. 7, but showing the center recess in the outer face of the corner seal.
Figure 17:
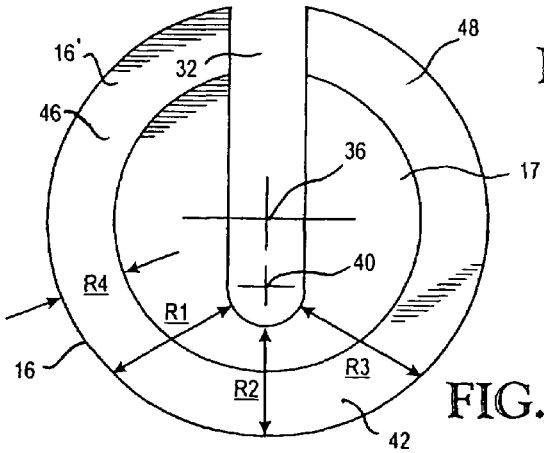
FIG. 17 is a view like FIG. 9, but showing the center recess in the outer face of the corner seal.
Figure 18:
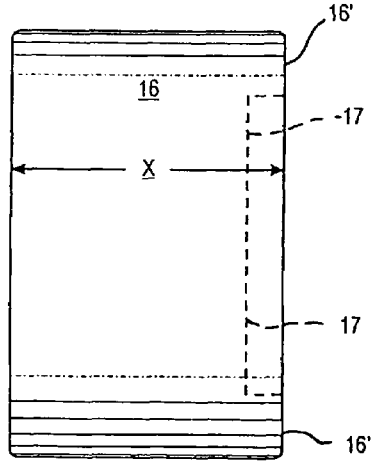
FIG. 18 is a view like FIG. 8, but showing the center recess in the outer face of the corner seal.

FIG. 1 shows a fragmentary portion of a rotor 10 within a stator 12. The rotor 10 and stator 12 may have the general shape shown by FIG. 1 of U.S. Pat. No. 3,851,999, granted Dec. 4, 1974, to William H. Bibbens. The rotor 10 is shown to include elongated side seals 14 embedded in the sidewalls of the rotor 10. As shown by FIG. 1 of U.S. Pat. No. 3,851,999, the side seals 14 are arcuate in shape and they extend between corner seals 16 which are provided at each end of each apex seal 18. An apex seal 18 is provided at the apex of each lobe L of the rotor 10. As shown by FIG. 3 herein, each apex seal 18 extends axially of the rotor 10, between the sidewalls 20, 22 of the housing or stator 12, in apex seal slots 24 formed in the rotor 10. Each slot 24 has a radial dimension or depth d (FIG. 3) and width w (FIG. 1). Corner seal sockets 26 are formed in the rotor 10 at the ends of the apex seal slots 12. As shown by FIGS. 1 and 4, when viewed together, the corner seal sockets 26 are generally cylindrical in shape. Each includes an inner wall 28 that is generally cylindrical in shape but includes a slot 30 which is an end portion of the apex seal slot 24 where it meets the corner seal socket 26. Each corner seal 16 has a body shape that is also substantially cylindrical. It includes an apex seal slot 32 which is in registry with the apex seal slot 24 in the rotor 10. Each corner seal socket 26 has an axial dimension that is longer than the axial dimension x of the corner seal 16 (FIGS. 4 and 9).

Referring to FIG. 8, the corner seal body 16 has a geometrical center 36 that is the center of a circle. In accordance with the invention, the apex seal slot 32 in the corner seal 16 is provided with a generally semi-cylindrical inner end 38. This inner end 38 has a geometrical center 40 that is the center of radius of the semi-cylindrical surface 38. Axis 36, 40 are parallel and are spaced apart a distance that is greater than the radius of surface 38. The slot 32 divides the corner seal 16 into two halves that are interconnected by an arcuate bight 42. The radial dimension of the arcuate bight 42 is smaller than the usual radial dimension of conventional corner seals. The curvature 38 cooperates with the curvature 44 to give the bight portion of the corner seal 16 a unique shape characterized by a varying radius. The radius starts at r1 and gets smaller until it reaches radius r2 and then it gets larger again when it gets to radius r3. Radii and r3 are substantially equal. The depth dimension of the arcuate bight 42, and the shape of the arcuate bight 42 result in a structural connection between the two sides 46, 48 of the corner seal 16 that resists the forces at the base of the apex seal slot 82 that cause breakage of the conventional corner seals.

In a typical installation, the corner seal 16 measures 0.4317+/−0.005 inches in diameter and 0.2700+/−0.005 inches in axial length. The depth of the apex seal slot 32, measured from the upper end opening to the center of the surface 38 is 0.3140+/−0.005 inches. The width of the apex seal slot 32 is 0.1175+/−0.001 inches. The radius of the surface 38 is 0.0558+/−0.001 inches. The offset distance between axis 36 and axis 40 is 0.0393+/−0.001 inches.

In preferred form, the apex seal 18 is of a two-part construction made up of minor part 18A and major part 18B. The parts 18A, 18B meet at a diagonal break line 50. The break line 50 allows for some expansion and contraction of the apex seal 18 in response to changes in temperature. Spring abutments 52, 54 are provided at the opposite ends of the apex seal 18. Abutment 52 projects radially inwardly from the minor part 18A and abutment 54 projects radially inwardly from the part 18B. As shown in FIG. 3, the outer end of seal part 18A contacts housing sidewall 20 and the outer end of seal part 18B contacts housing sidewall 22. The break 50 is located inwardly of the end from part 18A so that a linear surface 52 exists outwardly of the break 50. This linear surface 52 contacts and slides on the peripheral surface 54. A radial space 56 exists below the apex seal 18 and above the base of an apex seal slot 58 in the rotor 10. An arcuate spring 60 is positioned between the base of the slot 58 and the apex seal 18. Seal 60 is arcuate in form. It is radially outwardly concave and radially inwardly convex. Opposite ends 62, 64 of the spring 60 confront the spring abutments 52, 54 and at least at times contact the abutments 52, 54. The spring 60 biases the apex seal parts 18A, 18B radially outwardly against the surface 54. Despite the split 50, the seal parts 18A, 18B maintain the positions shown in FIG. 3.

Figure 2:
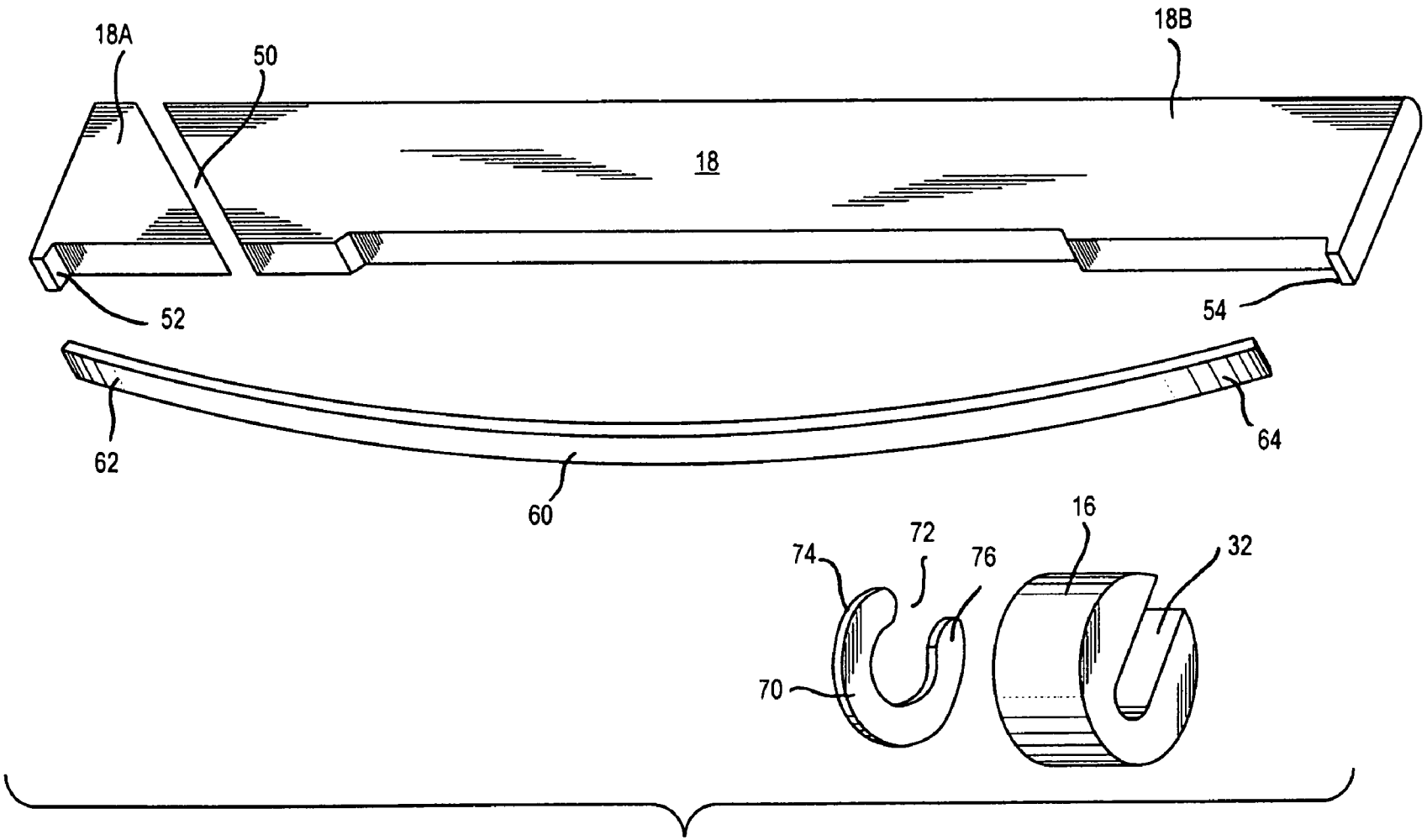
FIG. 2 is an exploded pictorial view of the apex seal, an apex seal spring, a corner seal and a twisted split washer corner seal spring.

FIG. 2 shows a twisted split washer spring 70 positioned inwardly of a corner seal 16. As shown by FIG. 3, a corner seal socket 26 exists at each end of the apex seal slot 58. As shown by FIG. 4, each socket 26 includes a radial inner wall 28 which confronts the inner end of its corner seal 16. A twisted split washer spring 70 is positioned in each socket 26, between the socket surface 28 and the corner seal 16 that is in the socket. Spring 70 includes a slot 72 through which the apex seal 18 and spring 60 extend. The apex seal 18 extends axially outwardly from the apex seal slot 58 in the rotor 10, through the end opening 30 (FIG. 4), then through the slot 72 and center space in spring 70, and then into the apex seal slot 32 formed in the corner seal 16. As shown by FIGS. 3 and 4, the spring ends 62, 64 contact the spring abutments 52, 54 within the slots 32. Referring to FIGS. 5 and 6, the opposite side portions 74, 76 are twisted in opposite direction a sufficient amount so that one side portion 74, 76 contacts the base wall 28 of the socket 26 while the other side portion 74, 76 contacts the inner end surface of the corner seal 16 and the spring is loaded to some extent. When all of the seals and springs are installed, the springs 60 bias the apex seals 18 outwardly into contact with the peripheral surface 54, the seals 14 are in contact with the housing sidewalls 20, 22, and the outer end surfaces of the corner seals 16 are in contact with the sidewall surfaces 20, 22.

FIGS. 14-18 are like claims 1-9 except they relate to an embodiment that includes a center recess 17 in the outer face of each corner seal 16'. The recess 17 removes contact area from the corner seal 16' so that only a radially narrow end surface of the corner seal 16' makes contact with the adjoining sidewall of the housing. The radial dimension R4 is less than the radius of the recess 17 and is preferably less than the radius R2. This decrease in contact area of the corner seal 16' with the adjoining sidewall of the housing substantially reduces drag and friction generated heat, resulting in a substantial increase in the useful life of the entire seal assembly, including the apex seal and its spring, it also results in an increase in engine power. The contact area is generally annular in shape. The annular shape is interrupted by the slot 32 but the substantially annular surface that is left will provide a satisfactory seal. The radius R4 must be sufficiently large to provide a sufficient area of contact to make the seal that is required. Any increase in the radial dimension R4 will increase the contact area and the resulting drag and friction caused heat. Accordingly, the radial dimension R4 must be kept relatively small in order to achieve the objectives and advantages of the invention.

The illustrated embodiments are only examples of the present invention and, therefore, is non-limitive. It is to be understood that many changes in the particular structure, materials and features of the invention may be made without departing from the spirit and scope of the invention. Therefore, it is my intention that my patent rights not be limited by the particular embodiments that are illustrated and described herein but that they be determined by the claims that follow, interpreted by use of established doctrines of patent claim interpretation.

What is claimed is:

1. A rotary engine, comprising:

a housing having spaced apart sidewalls and a peripheral wall, together forming a rotor chamber;

a rotor in said rotor chamber, mounted for rotation about an axis that extends perpendicular to the sidewalls, said rotor having a periphery that includes at least one lobe, said lobe having an apex and apex seal slot in the apex;

a corner seal socket in the rotor at each end of the apex seal slot;

a corner seal in each corner seal socket, each corner seal having a generally cylindrical body that includes inner and outer sides and a generally cylindrical periphery;

an apex seal slot formed in each corner seal, each apex seal slot having an arcuate inner end portion and sides that extend radially outwardly from the arcuate inner end portion to an outer end slot opening;

an apex seal in the apex seal slot in the lobe of the rotor, said apex seal having opposite end portions that extend into the apex seal slots in the corner seals;

wherein the generally cylindrical body has a geometrical center axis, and the arcuate inner end portions of the apex seal slot in the corner seal has a geometrical axis that is spaced from and parallel to the geometrical axis of the generally cylindrical body of the corner seal;

wherein a distance between the geometrical axis of the generally cylindrical body of the corner seal and the geometrical axis of the arcuate inner end portion of the apex seal slot is larger than the radius of the arcuate inner end portion of the apex seal slot in the corner seal; and each corner seal having an outer face that includes a center recess surrounded by a sealing surface that contacts a sidewall of the housing at its end of the rotor, said sealing surface having a radial dimension that is less than the radial dimension of the corner seal.

2. The rotary engine of claim 1, wherein the sealing surface of each corner seal has a radial dimension that is less than one-half of the radial dimension of the corner seal.

3. The rotary engine of claim 1, wherein the generally cylindrical body of the corner seal has a diameter and a side-to-side width and the diameter is larger than the side-to-side width.

4. The rotary engine of claim 1, comprising an inner end wall in each corner seal socket and a twisted washer spring in each corner seal socket, axially between the inner end wall of the socket and the corner seal that is in the socket, said twisted washer springs each having a slot that is in alignment with the apex seal slot in the lobe and the apex seal slots in the corner seals, and wherein the opposite end portions of the apex seal extend from the slot in the lobe of the rotor, through the slots in the twisted washer springs, into the apex seal slots in the corner seals.

5. The rotary engine of claim 1, wherein the opposite end portions of the apex seal include radially inwardly extending spring end abutments, and an arcuate leaf spring is positioned in the apex seal slot below the apex seal, said leaf spring being radially outwardly concave and radially inwardly convex and having ends contiguous the spring end abutments.

6. The rotary engine of claim 5, wherein the spring end abutments are in the apex seal slots in the corner seals and the leaf springs extend at their ends into the apex seal slots in the corner seals.

7. The rotary engine of claim 5, comprising an inner end wall in each corner seal socket and a twisted washer spring in each corner seal socket axially between the inner end wall of the socket and the corner seal that is in the socket, said twisted washer springs each having a slot that is in alignment with the apex seal slot in the lobe and the apex seal slots in the corner seals, and wherein the opposite end portions of the apex seal extend from the slot in the lobe of the rotor, through the slots in the twisted washer seal, into the apex seal slots in the corner seals.

8. The rotary engine of claim 7, wherein at its end, the arcuate apex seal spring extends through the slots in the twisted washer springs, into the apex seal slots in the corner seals, into a position adjacent the lower corner abutments on the apex seal.

9. The rotary engine of claim 1, wherein the apex seal is divided by a break into major and minor portions, and each of said apex seal portions has a length dimension confronting the peripheral wall of the housing.

10. The rotary engine of claim 9, comprising an inner end wall in each corner seal socket and a twisted washer spring in each corner seal socket, axially between the inner end wall of the socket and the corner seal that is in the socket, said twisted washer springs each having a slot that is in alignment with the apex seal slot in the lobe and the apex seal slots in the corner seals, and wherein the opposite end portions of the apex seal extend from the slot in the lobe of the rotor, through the slots in the twisted washer springs, into the apex seal slots in the corner seals.

* * * * *